US010301551B2

(12) United States Patent
Carter et al.

(10) Patent No.: US 10,301,551 B2
(45) Date of Patent: May 28, 2019

(54) MODULAR CRUDE REFINING PROCESS

(71) Applicant: UOP LLC, Des Plaines, IL (US)

(72) Inventors: Elizabeth A. Carter, Arlington Heights, IL (US); Saadet Ulas Acikgoz, Des Plaines, IL (US); Nicholas W. Bridge, Oak Park, IL (US); Christopher D. Gosling, Roselle, IL (US); Gavin P. Towler, Inverness, IL (US)

(73) Assignee: UOP LLC, Des Plaines, IL (US)

( * ) Notice: Subject to any disclaimer, the term of this patent is extended or adjusted under 35 U.S.C. 154(b) by 30 days.

(21) Appl. No.: 15/619,149

(22) Filed: Jun. 9, 2017

(65) Prior Publication Data

US 2018/0002611 A1 Jan. 4, 2018

Related U.S. Application Data

(60) Provisional application No. 62/357,251, filed on Jun. 30, 2016.

(51) Int. Cl.
*C10G 7/00* (2006.01)
*C10G 67/02* (2006.01)

(52) U.S. Cl.
CPC ..... *C10G 7/00* (2013.01); *C10G 67/02* (2013.01); *C10G 2300/202* (2013.01); *C10G 2300/205* (2013.01)

(58) Field of Classification Search
CPC ..... C10G 7/00; C10G 67/02
See application file for complete search history.

(56) References Cited

U.S. PATENT DOCUMENTS

| | | | | |
|---|---|---|---|---|
| 3,100,006 | A | 8/1963 | Sheets et al. | |
| 4,087,354 | A * | 5/1978 | Hessler | C10G 7/00 208/251 R |
| 4,363,718 | A | 12/1982 | Klotz | |
| 4,983,259 | A | 1/1991 | Duncan et al. | |
| 8,231,775 | B2 | 7/2012 | McGehee et al. | |
| 8,608,950 | B2 | 12/2013 | Serban et al. | |
| 9,181,500 | B2 | 11/2015 | Zhu et al. | |
| 9,284,499 | B2 | 3/2016 | Van et al. | |
| 2009/0115079 | A1 | 5/2009 | Trompiz | |
| 2011/0083997 | A1 | 4/2011 | Silva et al. | |
| 2016/0160130 | A1 * | 6/2016 | Martin | C10G 7/06 208/354 |

FOREIGN PATENT DOCUMENTS

| | | | |
|---|---|---|---|
| CN | 202315648 | U | 7/2012 |
| EP | 417407 | A1 | 3/1991 |

OTHER PUBLICATIONS

S. Parkash, Refining Processes Handbook, p. 10 (2013).*
Parkash, "Petroleum Fuels Manufacturing Handbook", 2010, p. 13-14, fig. 2-1, table 2-1, fig. 2-4, p. 19-20, [on-line] http://s1.downloadmienphi.net/file/downloadfile3/206/1396437.pdf.
Parkash, "Refining Processes Handbook", 2003, p. 10, fig. 1-3, [on-line], http://lib.hcmup.edu.vn:8080/eFileMgr/efile_folder/efile_local_folder/2013/12/2013-12-03/tvefile.2013-12-03.9286759817.pdf.
Seo et. al., Design optimization of crude oil distillation, Chemical Engineering and Technology, v 23, n 2, p. 157-164, Feb. 2000.
Huang; Crude Unit Preheat Recovery Optimization, 68th Aiche Annu Meet (Los Ang 11/16-20/75) Pap N.76A 31P, Nov. 16, 1975.
Huebel et. al., Offshore Report/Modular Plants Make Remote Offshore Gas Commercial, Oil Gas J. V77 N.18 216,220,222,227,230 (Apr. 30, 1979), v 77, n 18, p. 216,220,222,227,230, Apr. 30, 1979.
Catranescu et. al. Improving middle distillate production in a CDU, CHISA 2012—20th International Congress of Chemical and Process Engineering and PRES 2012 15th Conference PRES, 2012, CHISA 2012—20th International Congress of Chemical and Process Engineering and PRES 2012—15th Conference PRES.

* cited by examiner

*Primary Examiner* — Randy Boyer
(74) *Attorney, Agent, or Firm* — Paschall and Maas Law Office; James C. Paschall

(57) ABSTRACT

A crude distillation and refining process and apparatus enables modular supply of the crude distillation column. Crude oil may be heated and then separated into only two liquid products in the crude distillation column. The separation between the light and heavy products may be controlled by the overhead product flow rate. Heat is recovered from an overhead stream and a bottoms stream by preheating the incoming crude oil stream by heat exchange with overhead stream and the bottoms stream. In an embodiment, a diesel-range distillate fraction may be condensed from an overhead stream in a first heat exchanger and a naphtha-range fraction may be condensed from the gas stream uncondensed by the first heat exchanger in a second heat exchanger.

20 Claims, 2 Drawing Sheets

MODULAR CRUDE REFINING PROCESS

CROSS-REFERENCE TO RELATED APPLICATION

This application claims priority from Provisional Application No. 62/357,251 filed Jun. 30, 2016, the contents of which cited application are hereby incorporated by reference in its entirety.

BACKGROUND

The field of the invention is the refinement of crude petroleum streams.

RELATED PRIOR ART

Crude distillation columns fractionate crude oil streams removed from the ground. The crude distillation columns typically separate a gas stream in the overhead and atmospheric resid stream in the bottom with intermediate side cut streams of naphtha, kerosene, diesel, and atmospheric gas oil. These side cut stream are typically stripped to remove gases and are cooled and pumped back to the column to remove heat. The atmospheric resid bottoms stream is typically fed to a vacuum distillation column to produce a vacuum gas oil stream in the overhead and vacuum resid stream in the bottoms.

Modular small refineries of throughputs in the range of 20,000 to 50,000 barrels per day are increasingly becoming an option for crude producers in remote regions, particularly where there is a need to adapt quickly to meet local demand and take advantage of governmental incentives.

Crude distillation columns present a particular challenge for fast design, supply, and construction. For example, a typical crude distillation column that processes 20,000 barrels of crude oil per day with five products of naphtha, kerosene, diesel, atmospheric gas oil and atmospheric resid is typically around 150 feet tall and twelve feet in diameter. The column equipment is a challenge for shipping to remote regions because of its size and weight. Also, a typical crude distillation column has a heat exchanger network that is a complex network of split streams, pump around loops, and product coolers. The energy efficiency achieved by this optimized heat exchanger network significantly increases the required design time and decreases the flexibility of the operating unit.

Improved processes for fractionating crude streams in remote locations are needed. Also needed are equipment for processes for fractionating crude streams that can be transported to remote locations.

SUMMARY

We have discovered a process and apparatus for fractionating a crude oil stream in a remote location. The crude distillation column may only produce an overhead stream of distillate and a bottoms stream of reduced crude. The column will fit in an intermodal container with dimensions of 8.5 ft.×8.5 ft.×45 ft. and be able to process 50,000 barrels per day of crude oil.

DEFINITIONS

Figure 1:
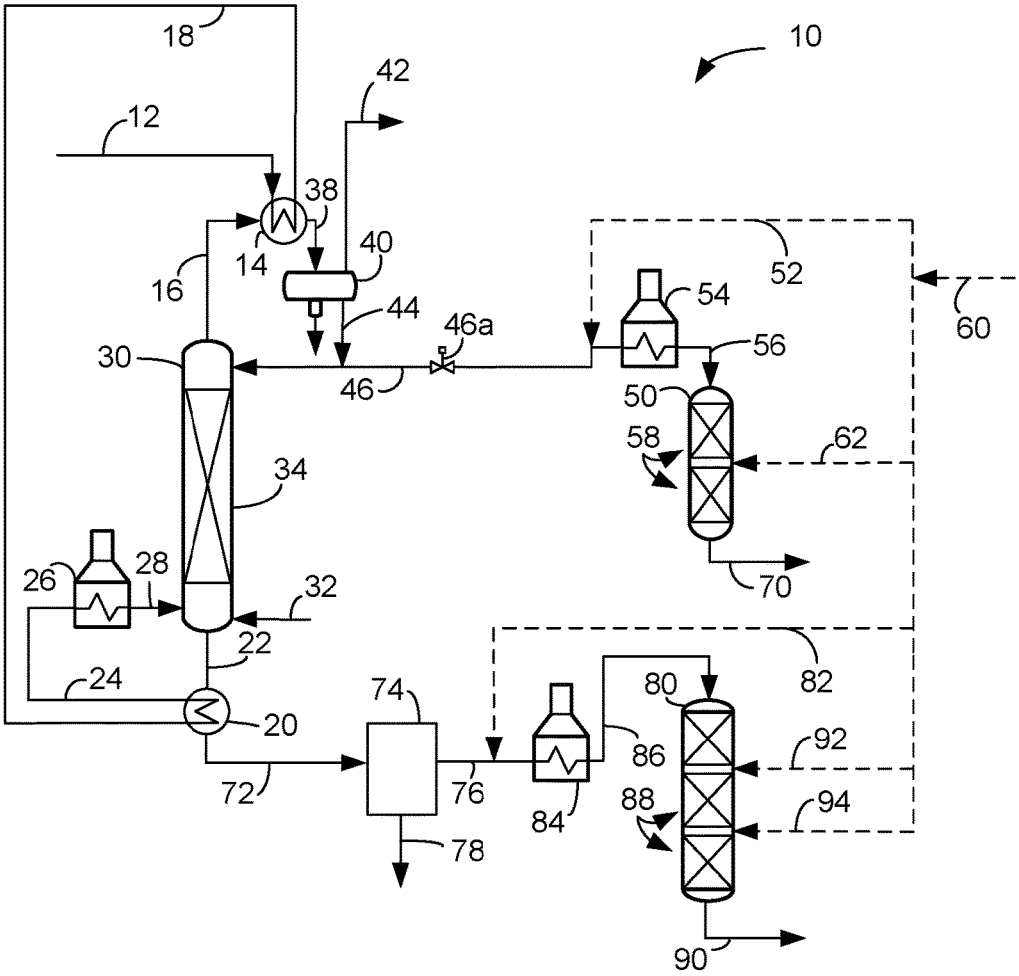
FIG. 1 is a flow scheme showing a process and apparatus of the present invention.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "column" means a distillation column or columns for separating one or more components of different volatilities. Unless otherwise indicated, each column includes a condenser on an overhead of the column to condense and reflux a portion of an overhead stream back to the top of the column[CE1]. Feeds to the columns may be preheated. The overhead pressure is the pressure of the overhead vapor at the vapor outlet of the column. The bottom temperature is the liquid bottom outlet temperature. Overhead lines and bottoms lines refer to the net lines from the column downstream of any reflux or reboil to the column unless otherwise indicated. Stripping columns omit a reboiler at a bottom of the column and instead provide heating requirements and separation impetus from a fluidized inert vaporous media such as steam.

As used herein, the term "True Boiling Point" (TBP) means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "initial boiling point" (IBP) means the temperature at which the sample begins to boil using ASTM D-86.

As used herein, the term "T5" or "T95" means the temperature at which 5 volume percent or 95 volume percent, as the case may be, respectively, of the sample boils using ASTM D-86.

As used herein, the term "diesel boiling range" means hydrocarbons boiling in the range of between about 132° C. (270° F.) and the diesel cut point between about 343° C. (650° F.) and about 399° C. (750° F.) using the TBP distillation method.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator which latter may be operated at higher pressure.

DETAILED DESCRIPTION

A crude distillation and refining process enables modular supply of the crude distillation column. Crude oil may be heated and then separated into only two liquid products in the crude distillation column. The separation between the light and heavy products may be controlled by the overhead product flow rate. The quality of the separation between the light and heavy products may be determined by temperature of an incoming crude oil stream, column internals efficiency, column pressure, and stripping steam addition, if any. Heat is recovered from an overhead stream and a bottoms stream by pre-heating the incoming crude oil stream by heat exchange with overhead stream and the bottoms stream. In an embodiment, a diesel-range distillate fraction may be condensed from an overhead stream in a first heat exchanger and a naphtha-range fraction may be condensed from the gas stream uncondensed by the first heat exchanger in a second heat exchanger.

The process and apparatus 10 for refining a crude oil stream in crude line 12 is shown in FIG. 1. Crude oil from a source may comprise all or part of a crude feed stream recovered from a well. The crude oil stream may be a heavy hydrocarbon stream comprising heavy oil or bitumen. Whole bitumen may include resins and asphaltenes, which are complex polynuclear hydrocarbons, which add to the viscosity of the crude oil and increase the pour point. Crude feed may also include conventional crude oil, coal oils, residual oils, tar sands, shale oil, deasphalted oil and asphaltic fractions.

The crude oil stream typically has an API gravity of between about 20 and about 40 API. Waxy crude oil streams typically have a higher API in excess of 25, but a pour point of between about 20° and 50° C. The viscosity of the crude oil stream may be between about 1 and about 20,000 cSt at about 40° C. Crude oil may have a boiling point range in which about 40 to about 70 vol % of the stream boils at 343° C. (650° F.). The crude oil stream in crude line 12 may typically be subjected to heating and separation of an oil phase from a water phase to dewater the crude oil stream prior to fractionation.

The crude oil stream in line 12 may be heated by heat exchange in an overhead heat exchanger 14 with an overhead distillate stream in overhead line 16. This heat exchange in turn cools the overhead distillate stream in overhead line 16 by heat exchange with the crude oil stream in crude line 12. A heated crude oil stream in a heated crude line 18 may be fed to a crude distillation column 30. In an aspect, the heated crude oil stream may be further heated by heat exchange in a bottoms heat exchanger 20 with a reduced crude stream in a bottoms line 22. Heating of the crude oil stream in the bottoms heat exchanger 20 may follow heating in the overhead heat exchanger. This heat exchange in turn cools the reduced crude stream in the bottoms line 22 by heat exchange with the heated crude oil stream in the heated crude line 12. A twice-heated crude oil stream in a twice heated crude line 24 may be fed to the crude distillation column 30. In a further aspect, the twice heated crude stream in the twice heated crude line may be further heated in a fired heater 26 to provide a fired crude stream in a column feed line 28. The fired crude stream may then be fed to the crude distillation column 30 in the column feed line 28. Instead of or in addition to the firing the crude oil stream in the fired heater 26, heat may be added to the crude distillation column 30 by steam or other inert gas added by stripping line 32 to provide sufficient distillation heat requirements.

In the crude distillation column the heated, twice heated or fired crude oil stream is fractionated to provide the overhead distillate stream in the overhead line 16 and a reduced crude stream in the bottoms line 22 at a cut point between 288° C. (550° F.) and 371° C. (700° F.) and preferably between 316° C. (600° F.) and 357° C. (675° F.). A sharp split between the overhead distillate stream and the reduced crude stream in the crude unit is unnecessary because fractionation downstream of subsequent conversion units will provide the opportunity to meet final product specifications.

Because the crude distillation column 30 only produces two streams, the crude distillation column only requires 3-6 theoretical stages, which can be achieved in less than 12.2 m (40 ft.) height. Because a sharp split between the two fractionated streams is unnecessary, the crude distillation column 30 may be designed with a diameter of less than 2.5 m (8.5 ft.) for a column that fractionates up to 7,949 cubic meters (50,000 barrels) of crude per day. The crude distillation column will fit inside a standard intermodal container 2.5 m×2.5 m×12.2 m (8.5 ft.×8.5 ft.×45 ft.). This allows shipping to very remote and inland locations. However, this crude rate is large enough for refiners to profit from economies of scale.

The crude distillation column pressure may be run between about 344 kPa (gauge) (50 psig) to about 689 kPa (gauge) (100 psig) instead of the typically slightly above atmospheric pressure. The higher pressure reduces the volume of the vapor in the upper section of the column allowing reduction of the column diameter. However, lower pressure may improve the separation between distillate and resid fractions.

The steam rate in the stripping line 32 to the bottom of the crude distillation column 30 is minimized to be less than the typical 28 kg steam/cubic meter reduced crude in bottoms line 22 (10 lb steam/bbl bottoms). In an aspect, the steam rate is less than 14 kg steam/cubic meter reduced crude in bottoms line 22 (5 lb steam/bbl bottoms). In a further aspect, the steam rate is eliminated. However, the addition of stripping steam may improve the separation between distillate and resid fractions.

The column internals 34 are selected to maximize vapor volumetric flow rate through the top section of the crude distillation column 30. In an aspect, the column internals 34 may comprise random packing. Preferably, the column internals 34 comprise a structured packing. The maximum crude throughput through the crude distillation column 30 is determined by the distillate content of the crude oil and desired degree of separation between the distillate and reduced crude fractions. The throughput of the column can be increased by selecting column internals 34 that have higher hydraulic capacities, by increasing the column pressure, or by the reduction or elimination of stripping steam rate.

No side streams need be taken from the side of the crude distillation column 30. Accordingly, no side stream is striped in a side stripper and no side stream is cooled and pumped back to the crude distillation column 30. Pump around loops are eliminated and reflux is required only for the one overhead separation. Consequently, all of the material fed to the crude distillation column 30 in feed line 28 exits the crude distillation column 30 upon fractionation through the overhead line 16 or the bottoms line 22.

The overhead distillate stream in the overhead line 16 is cooled by heat exchange in the overhead heat exchanger 14 and condensed. A cooled overhead distillate stream in line 38 is transported to an overhead receiver 40. A separation in the overhead receiver 40 provides an overhead gaseous stream in an overhead gaseous line 42 and a liquid distillate stream in line 44. The column may be operated to minimize or eliminate the flow rate of the gaseous overhead stream in the overhead gaseous line 42. A reflux portion of the liquid distillate stream in line 44 is refluxed back to the crude distillation column 30 and a net distillate stream is taken in the net distillate line 46. The overhead product draw flow rate through the net distillate line 46 governed by a control valve 46*a* on line 46 regulates the separation between the overhead distillate stream in the overhead line 16 and the reduced crude stream in the bottoms line 22.

In an aspect, the net distillate stream in the net distillate line 46 may include naphtha, kerosene and diesel fractions. The net distillate stream may jointly hydrotreated in a hydrotreating reactor 50. A hydrotreating hydrogen stream in line 52 from a hydrogen line 60 may be added to the net distillate stream 46 be heated perhaps in a fired heater 54 and fed to the hydrotreating reactor 50 in a hydrotreater feed line 56.

Hydrotreating is a process wherein hydrogen is contacted with hydrocarbon in the presence of hydrotreating catalysts which are primarily active for the removal of heteroatoms, such as sulfur, nitrogen and metals from the hydrocarbon feedstock. In hydrotreating, hydrocarbons with double and triple bonds may be saturated. Aromatics may also be saturated.

The hydrotreating reactor 50 may comprise beds 58 of hydrotreating catalyst. A guard bed of hydrotreating catalyst may be followed by one or more beds of higher quality hydrotreating catalyst. The guard bed filters particulates and picks up contaminants in the hydrocarbon feed stream such as metals like nickel, vanadium, silicon and arsenic which deactivate the catalyst. The guard bed may comprise material similar to the hydrotreating catalyst. A heavy tail on the net distillate stream from the crude distillation column 30 may be eliminated with a small amount of hydrocracking catalyst in the hydrotreating reactor 50. Supplemental hydrogen in a hydrotreating supplemental hydrogen line 62 may be added at an interstage location between catalyst beds 58 in the hydrotreating reactor 50.

Suitable hydrotreating catalysts for use in the hydrotreating reactor are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts. More than one type of hydrotreating catalyst may be used in the hydrotreating reactor 50. The Group VIII metal is typically present in an amount ranging from about 2 to about 20 wt %, preferably from about 4 to about 12 wt %. The Group VI metal will typically be present in an amount ranging from about 1 to about 25 wt %, preferably from about 2 to about 25 wt %.

Preferred reaction conditions in the hydrotreating reactor 50 include a temperature from about 290° C. (550° F.) to about 455° C. (850° F.), suitably 316° C. (600° F.) to about 427° C. (800° F.) and preferably 343° C. (650° F.) to about 399° C. (750° F.), a pressure from about 2.1 MPa (gauge) (300 psig), preferably 4.1 MPa (gauge) (600 psig) to about 20.6 MPa (gauge) (3000 psig), suitably 13.8 MPa (gauge) (2000 psig), preferably 12.4 MPa (gauge) (1800 psig), a liquid hourly space velocity of the fresh hydrocarbonaceous feedstock from about 0.1 $hr^{-1}$, suitably 0.5 $hr^{-1}$, to about 10 $hr^{-1}$, preferably from about 1.5 to about 8.5 $hr^{-1}$, and a hydrogen rate of about 168 $Nm^3/m^3$ (1,000 scf/bbl), to about 1,011 $Nm^3/m^3$ oil (6,000 scf/bbl), preferably about 168 $Nm^3/m^3$ oil (1,000 scf/bbl) to about 674 $Nm^3/m^3$ oil (4,000 scf/bbl), with a hydrotreating catalyst or a combination of hydrotreating catalysts.

The net distillate stream in the hydrotreater feed line 56 is hydrotreated over the hydrotreating catalyst in the first hydrotreating reactor 50 to provide a hydrotreated stream that exits the first hydrotreating reactor 50 in a hydrotreating effluent line 70. The hydrotreated stream may be separated while cooled and reduced in pressure, stripped of acid gases and fractionated into naphtha, kerosene and diesel product streams. The hydrogen gas separated from the hydrotreated stream may be purified of ammonia and hydrogen sulfide, compressed and recycled back in line 52.

The reduced crude stream in line 22 may be hydrocracked into products boiling at or below the diesel cut point. The reduced crude stream in bottoms line 22 may be cooled by heat exchange with the crude oil feed stream in line 18 in heat exchanger 20 to provide a cooled reduced crude stream in the cooled reduced crude line 72. The cooled reduced crude stream in cooled reduced crude line 72 may contain heavy metals. In an aspect, the cooled reduced crude stream may undergo optional treating to remove sulfur, nitrogen and heavy metals in a heavy metal reduction unit 74. In an alternative aspect the entire cooled reduced crude stream is fed to a hydrocracking reactor 80.

The optional heavy metal reduction unit 74 may comprise one or more units to remove heavy metals such as a vacuum distillation column, taught for example in U.S. Pat. No. 8,231,775 B2; a solvent deasphalting unit, taught for example in U.S. Pat. No. 9,284,499 B2; a ionic liquid resid extraction unit, taught for example in U.S. Pat. No. 8,608,950 B2; and a resid hydrotreating unit, taught for example in U.S. Pat. No. 9,181,500 B2. The purified reduced crude stream exits the heavy metal reduction unit 74 in purified line 76 and is transported to the hydrocracking reactor 80. The heavy metal-rich stream is removed from the heavy metal reduction unit 74 in line 78.

A hydrocracking hydrogen stream in line 82 from the hydrogen line 60 may be added to the reduced crude stream in the cooled reduced crude line 72 or the purified line 76, be heated perhaps in a fired heater 84 and fed to the hydrocracking reactor 80 in a hydrocracker feed line 86.

Hydrocracking is a process in which hydrocarbons crack in the presence of hydrogen to lower molecular weight hydrocarbons. The hydrocracking reactor 80 may be a fixed bed reactor that comprises one or more vessels, single or multiple catalyst beds 84 in each vessel, and various combinations of hydrotreating catalyst, hydroisomerization catalyst and/or hydrocracking catalyst in one or more vessels. The hydrocracking reactor 80 may be operated in a conventional continuous gas phase, continuous liquid phase, a moving bed or a fluidized bed hydroprocessing reactor.

The hydrocracking reactor 80 comprises a plurality of hydrocracking catalyst beds 88. If the hydrocracking reactor is not proceeded by a heavy metal reduction unit 74, the first catalyst bed 84 in the hydrocracking reactor 80 may include a hydrotreating catalyst for the purpose of demetallizing, desulfurizing or denitrogenating the reduced crude stream before it is hydrocracked with hydrocracking catalyst in subsequent vessels or catalyst beds 88 in the hydrocracking reactor 80. Otherwise, the first or an upstream bed in the first hydrocracking reactor 80 may comprise a hydrocracking catalyst bed 88.

A hydrocracking reduced crude feed stream in the hydrocracker feed line 86 is hydrocracked over a hydrocracking catalyst in the hydrocracking catalyst beds 88 in the presence of the hydrocracking hydrogen stream to provide a hydrocracked stream. Supplemental hydrogen in hydrocracking supplemental hydrogen lines 92, 94 may be added at interstage locations between catalyst beds 88 in the hydrocracking reactor 80, so supplemental hydrogen is mixed with hydrocracked effluent exiting from the upstream catalyst bed 84 before entering the downstream catalyst bed 88.

The hydrocracking reactor 80 may provide a total conversion of at least about 20 vol % and typically greater than about 60 vol % of the hydrocracking feed stream in the hydrocracker feed line 86 to products boiling below the diesel cut point. The hydrocracking reactor 80 may operate at partial conversion of more than about 30 vol % or full conversion of at least about 90 vol % of the feed based on total conversion. The hydrocracking reactor 80 may be operated at mild hydrocracking conditions which will provide about 20 to about 60 vol %, preferably about 20 to about 50 vol %, total conversion of the hydrocarbon feed stream to product boiling below the diesel cut point.

The hydrocracking catalyst may utilize amorphous silica-alumina bases or low-level zeolite bases combined with one or more Group VIII or Group VIB metal hydrogenating components if mild hydrocracking is desired to produce a balance of middle distillate and gasoline. In another aspect, when middle distillate is significantly preferred in the converted product over gasoline production, partial or full hydrocracking may be performed in the hydrocracking reactor 80 with a catalyst which comprises, in general, any crystalline zeolite cracking base upon which is deposited a Group VIII metal hydrogenating component. Additional hydrogenating components may be selected from Group VIB for incorporation with the zeolite base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8 and 12 Angstroms ($10^{-10}$ meters), wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,100,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 wt %, and preferably at least about 20 wt %, metal-cation-deficient, based on the initial ion-exchange capacity. In another aspect, a desirable and stable class of zeolites is one wherein at least about 20 wt % of the ion exchange capacity is satisfied by hydrogen ions.

The active metals employed in the preferred first hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 wt % and about 30 wt % may be used. In the case of the noble metals, it is normally preferred to use about 0.05 to about 2 wt % noble metal.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt %. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718.

By one approach, the hydrocracking conditions may include a temperature from about 290° C. (550° F.) to about 468° C. (875° F.), preferably 343° C. (650° F.) to about 445° C. (833° F.), a pressure from about 4.8 MPa (gauge) (700 psig) to about 20.7 MPa (gauge) (3000 psig), a liquid hourly space velocity (LHSV) from about 0.4 to less than about 2.5 $hr^{-1}$ and a hydrogen rate of about 421 $Nm^3/m^3$ (2,500 scf/bbl) to about 2,527 $Nm^3/m^3$ oil (15,000 scf/bbl). If mild hydrocracking is desired, conditions may include a temperature from about 315° C. (600° F.) to about 441° C. (825° F.), a pressure from about 5.5 MPa (gauge) (800 psig) to about 13.8 MPa (gauge) (2000 psig) or more typically about 6.9 MPa (gauge) (1000 psig) to about 11.0 MPa (gauge) (1600 psig), a liquid hourly space velocity (LHSV) from about 0.5 to about 2 $hr^{-1}$ and preferably about 0.7 to about 1.5 $hr^{-1}$ and a hydrogen rate of about 421 $Nm^3/m^3$ oil (2,500 scf/bbl) to about 1,685 $Nm^3/m^3$ oil (10,000 scf/bbl).

The hydrocracked stream may exit the hydrocracking reactor 80 in line 90 and may be separated while cooled and reduced in pressure, stripped of acid gases and fractionated into naphtha, kerosene and diesel product streams. Unconverted oil may be recycled to the hydrocracking reactor 80 or forwarded to a fluid catalytic cracking unit. The hydrogen gas separated from the hydrocracked stream may be purified of ammonia and hydrogen sulfide, compressed and recycled back in hydrogen line 82. Light ends in the reduced crude stream from the crude distillation column 30 will carry through the hydrocracking reactor 80 and will not cause a significant overall loss of fuel yield.

Figure 2:
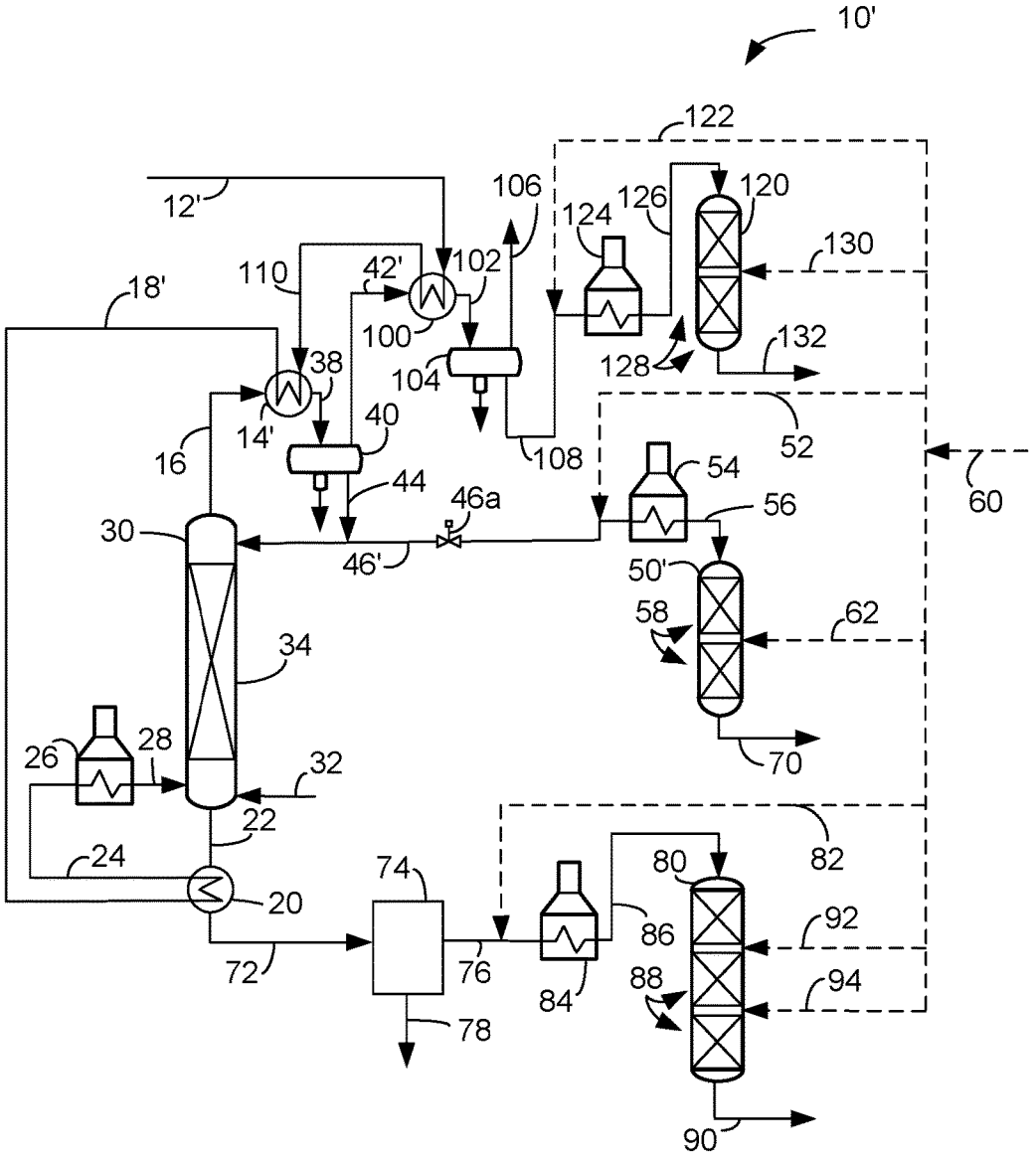
FIG. 2 is a flow scheme showing an alternative the process and apparatus of the present invention.

FIG. 2 is an alternative apparatus and process 10' of FIG. 1 which separates the distillate overhead stream into light and heavy distillate streams. Many of the elements in FIG. 2 have the same configuration as in FIG. 1 and bear the same reference number. Elements in FIG. 2 that correspond to elements in FIG. 1 but have a different configuration bear the same reference numeral as in FIG. 1 but are marked with a prime symbol (').

In the embodiment of FIG. 2, a net distillate stream in a net distillate line 46' comprises a heavy distillate stream which is hydrotreated in a distillate hydrotreating reactor 50' as described for FIG. 1. However, the overhead gaseous stream in the overhead gaseous line 42' is cooled by heat exchange in the overhead gaseous heat exchanger 100 and condensed. A cooled overhead gaseous stream in line 102 is transported to an overhead gaseous receiver 104. A separation in the overhead gaseous receiver 104 provides an off gas stream in an off gas line 106 and a liquid light distillate stream in a light distillate line 108 comprising naphtha.

In an aspect, the overhead gaseous stream is cooled by heat exchange with the crude oil stream in a crude line 12' thereby cooling the overhead gaseous stream in the overhead gaseous line 42' and heating the crude oil stream before heat exchanging the heated crude oil stream with the overhead distillate stream in overhead line 16. The heated crude oil stream in once-heated crude line 110 transports the heated crude stream from the overhead gaseous heat exchanger 100 to an overhead heat exchanger 14' and the heated crude stream is heat exchanged with the overhead distillate stream in overhead line 16 to further heat the heated crude oil stream in once-heated crude line 110 and cool the distillate overhead stream in line 16. A twice heated crude oil stream in line 18' is transported from the overhead heat exchanger 14' to a bottoms heat exchanger 20. The reduced crude stream in bottoms line 22 is cooled by heat exchange with the twice heated crude oil stream in line 18' after the crude oil stream is heat exchanged with the overhead distillate stream in line 16. The thrice heated crude stream in thrice heated crude line 24 from the bottoms heat exchanger 20 is then processed as explained for FIG. 1.

In an aspect, the light distillate stream in light distillate line 108 is hydrotreated in a light hydrotreating reactor 120 separately from the heavy distillate stream in line 46' hydrotreated in the heavy hydrotreating reactor 50'. A light hydrotreating hydrogen stream in line 122 from a hydrogen line 60 may be added to the light distillate stream in the light distillate line 108, be heated perhaps in a fired heater 124 and fed to the light hydrotreating reactor 120 in a light hydrotreater feed line 126.

The light hydrotreating reactor 120 may comprise beds 128 of hydrotreating catalyst. A guard bed of hydrotreating catalyst may be followed by one or more beds of higher quality hydrotreating catalyst. The guard bed filters particulates and picks up contaminants in the hydrocarbon feed stream such as metals like nickel, vanadium, silicon and arsenic which deactivate the catalyst. The guard bed may comprise material similar to the hydrotreating catalyst. A heavy tail on the net distillate stream from the crude distillation column 30 may be eliminated with a small amount of hydrocracking catalyst in the light hydrotreating reactor 120.

Supplemental hydrogen in a hydrotreating supplemental hydrogen line 130 may be added at an interstage location between catalyst beds 128 in the light hydrotreating reactor 120. The hydrotreating catalyst and operating conditions in the light hydrotreating reactor 120, may be the same or different as the hydrotreating catalyst in the hydrotreating reactor 50'.

The light distillate stream in the light hydrotreater feed line 126 is hydrotreated over the hydrotreating catalyst in the light hydrotreating reactor 120 to provide a light hydrotreated stream that exits the light hydrotreating reactor 120 in a light hydrotreating effluent line 132. The hydrotreated stream may be separated while cooled and reduced in pressure, stripped of acid gases and fractionated into naphtha, kerosene and diesel product streams. The hydrogen gas separated from the light hydrotreated stream may be purified of ammonia and hydrogen sulfide, compressed and recycled back in line 122.

The rest of FIG. 2 is as is described for FIG. 1.

Specific Embodiments

While the following is described in conjunction with specific embodiments, it will be understood that this description is intended to illustrate and not limit the scope of the preceding description and the appended claims.

A first embodiment of the invention is a process for refining a crude oil stream, comprising fractionating a crude oil stream in a crude column to provide an overhead distillate stream in an overhead line and a reduced crude stream in a bottoms line at a cut point between 550° and 700° F.; cooling the overhead distillate stream and condensing the overhead distillate stream to provide a net distillate stream and an overhead gaseous stream; and heat exchanging the reduced crude stream with the crude oil stream; wherein all of the feed to the column exits upon fractionation through the overhead line or the bottoms line. An embodiment of the invention is one, any or all of prior embodiments in this paragraph up through the first embodiment in this paragraph, wherein at least about 40 vol % of the crude stream boils at 343° C. An embodiment of the invention is one, any or all of prior embodiments in this paragraph up through the first embodiment in this paragraph, further comprising cooling the overhead distillate stream by heat exchange with the crude oil stream. An embodiment of the invention is one, any or all of prior embodiments in this paragraph up through the first embodiment in this paragraph, further comprising cooling the reduced crude stream by heat exchange it with the crude oil stream after the crude oil stream is heat exchanged with the overhead distillate stream. An embodiment of the invention is one, any or all of prior embodiments in this paragraph up through the first embodiment in this paragraph, wherein the net distillate stream comprises a heavy distillate stream and the further comprising cooling the overhead gaseous stream to provide a light distillate stream and an off gas stream. An embodiment of the invention is one, any or all of prior embodiments in this paragraph up through the first embodiment in this paragraph, further comprising cooling the overhead gaseous stream by heat exchange with the crude oil stream before heat exchanging the crude oil stream with the overhead distillate stream. An embodiment of the invention is one, any or all of prior embodiments in this paragraph up through the first embodiment in this paragraph, further comprising cooling the reduced crude stream by heat exchange it with the crude oil stream after the crude oil stream is heat exchanged with the overhead distillate stream. An embodiment of the invention is one, any or all of prior embodiments in this paragraph up through the first embodiment in this paragraph, further comprising hydrotreating the net distillate stream. An embodiment of the invention is one, any or all of prior embodiments in this paragraph up through the first embodiment in this paragraph, further comprising hydrocracking the reduced crude stream. An embodiment of the invention is one, any or all of prior embodiments in this paragraph up through the first embodiment in this paragraph, further comprising hydrotreating the heavy distillate stream and the light distillate stream.

A second embodiment of the invention is a process for refining a crude oil stream, comprising fractionating a crude oil stream in a crude column to provide an overhead distillate stream in an overhead line and a reduced crude stream in a bottoms line at a cut point between 600° and 700° F.; cooling the overhead distillate stream by heat exchange with the crude oil stream and condensing the overhead distillate stream to provide a net distillate stream and a overhead gaseous stream; and heat exchanging the reduced crude stream with the crude oil stream; wherein all of the feed to the column exits upon fractionation through the overhead line or the bottoms line. An embodiment of the invention is one, any or all of prior embodiments in this paragraph up through the second embodiment in this paragraph, wherein about 40 to about 70 vol % of the crude stream boils at 343° C. An embodiment of the invention is one, any or all of prior embodiments in this paragraph up through the second embodiment in this paragraph, wherein the net distillate stream comprises a heavy distillate stream and the further comprising cooling the overhead gaseous stream to provide a light distillate stream and an off gas stream. An embodiment of the invention is one, any or all of prior embodiments in this paragraph up through the second embodiment in this paragraph, further comprising hydrotreating the net distillate stream. An embodiment of the invention is one, any or all of prior embodiments in this paragraph up through the second embodiment in this paragraph, further comprising hydrocracking the reduced crude stream. An embodiment of the invention is one, any or all of prior embodiments in this paragraph up through the second embodiment in this paragraph, further comprising hydrotreating the heavy distillate stream and the light distillate stream.

A third embodiment of the invention is a process for refining a crude oil stream, comprising fractionating a crude oil stream in a crude column to provide an overhead distillate stream in an overhead line and a reduced crude stream in a bottoms line; cooling the overhead distillate stream and condensing the overhead distillate stream to provide a net distillate stream and an overhead gaseous stream; heat exchanging the reduced crude stream with the crude oil stream; hydrotreating the net distillate stream; and hydrocracking the reduced crude stream; wherein all of the feed to the column exits upon fractionation through the overhead line or the bottoms line. An embodiment of the invention is one, any or all of prior embodiments in this paragraph up through the third embodiment in this paragraph, further comprising a cut point between the overhead distillate stream and the reduced crude stream at between 600° and 700° F. An embodiment of the invention is one, any or all of prior embodiments in this paragraph up through the third embodiment in this paragraph, wherein the net distillate stream comprises a heavy distillate stream and the further comprising cooling the overhead gaseous stream to provide a light distillate stream and an off gas stream; and hydrotreating the heavy distillate stream and the light distillate stream. An embodiment of the invention is one, any or all of prior embodiments in this paragraph up through the third embodiment in this paragraph, wherein at least about 40 vol % of the crude stream boils at 343° C.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for refining a crude oil stream, comprising:
fractionating a crude oil stream in a crude column to provide an overhead distillate stream in an overhead line and a reduced crude stream in a bottoms line at a cut point between 288° and 371° C. (550° and 700° F.);
cooling the overhead distillate stream and condensing the overhead distillate stream to provide a net distillate stream and an overhead gaseous stream; and
heat exchanging the reduced crude stream with the crude oil stream;
wherein all of the feed to the column exits upon fractionation through the overhead line or the bottoms line.

2. The process according to claim 1, wherein at least about 40 vol % of said crude stream boils at 343° C.

3. The process according to claim 1, further comprising cooling the overhead distillate stream by heat exchange with the crude oil stream.

4. The process according to claim 3, further comprising cooling the reduced crude stream by heat exchange it with the crude oil stream after the crude oil stream is heat exchanged with the overhead distillate stream.

5. The process according to claim 1, wherein the net distillate stream comprises a heavy distillate stream and the further comprising cooling the overhead gaseous stream to provide a light distillate stream and an off gas stream.

6. The process according to claim 5, further comprising cooling the overhead gaseous stream by heat exchange with the crude oil stream before heat exchanging the crude oil stream with the overhead distillate stream.

7. The process according to claim 6, further comprising cooling the reduced crude stream by heat exchange it with the crude oil stream after the crude oil stream is heat exchanged with the overhead distillate stream.

8. The process according to claim 1, further comprising hydrotreating the net distillate stream.

9. The process according to claim 1, further comprising hydrocracking the reduced crude stream.

10. The process according to claim 5, further comprising hydrotreating the heavy distillate stream and the light distillate stream.

11. A process for refining a crude oil stream, comprising:
fractionating a crude oil stream in a crude column to provide an overhead distillate stream in an overhead line and a reduced crude stream in a bottoms line at a cut point between 316° and 371° C. (600° and 700° F.);
cooling the overhead distillate stream by heat exchange with the crude oil stream and condensing the overhead distillate stream to provide a net distillate stream and a overhead gaseous stream; and
heat exchanging the reduced crude stream with the crude oil stream;
wherein all of the feed to the column exits upon fractionation through the overhead line or the bottoms line.

12. The process according to claim 11, wherein about 40 to about 70 vol % of said crude stream boils at 343° C.

13. The process according to claim 11, wherein the net distillate stream comprises a heavy distillate stream and the further comprising cooling the overhead gaseous stream to provide a light distillate stream and an off gas stream.

14. The process according to claim 11, further comprising hydrotreating the net distillate stream.

15. The process according to claim 11, further comprising hydrocracking the reduced crude stream.

16. The process according to claim 13, further comprising hydrotreating the heavy distillate stream and the light distillate stream.

17. A process for refining a crude oil stream, comprising:

fractionating a crude oil stream in a crude column to provide an overhead distillate stream in an overhead line and a reduced crude stream in a bottoms line;

cooling the overhead distillate stream and condensing the overhead distillate stream to provide a net distillate stream and an overhead gaseous stream;

heat exchanging the reduced crude stream with the crude oil stream;

hydrotreating the net distillate stream; and hydrocracking the reduced crude stream;

wherein all of the feed to the column exits upon fractionation through the overhead line or the bottoms line.

18. The process according to claim 17, further comprising a cut point between the overhead distillate stream and the reduced crude stream at between 316° and 371° C. (600° and 700° F.).

19. The process according to claim 17, wherein the net distillate stream comprises a heavy distillate stream and the further comprising cooling the overhead gaseous stream to provide a light distillate stream and an off gas stream; and hydrotreating the heavy distillate stream and the light distillate stream.

20. The process according to claim 17, wherein at least about 40 vol % of said crude stream boils at 343° C.

* * * * *